US005414211A

United States Patent [19]

Chan

[11] Patent Number: 5,414,211

[45] Date of Patent: May 9, 1995

[54] DEVICE AND METHOD FOR SHIELDING AN ELECTRICALLY CONDUCTIVE CABLE FROM ELECTROMAGNETIC INTERFERENCE

[75] Inventor: Edward K. C. Chan, Washington, D.C.

[73] Assignee: E-Systems, Inc., Dallas, Tex.

[21] Appl. No.: 993,842

[22] Filed: Dec. 21, 1992

[51] Int. Cl.[6] ..... H01B 11/18

[52] U.S. Cl. ..... 174/36; 29/828; 87/9; 156/51; 174/109; 174/126.2; 439/578

[58] Field of Search ..... 174/36, 109, 126.2; 156/51, 52; 29/828; 439/578; 87/8, 9

[56] References Cited

U.S. PATENT DOCUMENTS

| | | | |
|---|---|---|---|
| 2,438,146 | 3/1948 | Candee et al. | 174/36 |
| 2,514,905 | 7/1950 | Solero | 174/36 |
| 2,924,141 | 2/1960 | Kinniburgh | 174/36 |
| 3,594,491 | 7/1971 | Zeidlhack | 174/36 |
| 3,595,985 | 7/1971 | Zelley | 174/119 R |
| 3,686,428 | 8/1972 | Lombard, et al. | 174/126.2 |
| 3,985,948 | 10/1976 | Olszewski et al. | 174/28 |
| 4,059,330 | 11/1977 | Shirey | 439/578 |
| 4,345,370 | 8/1982 | Cartier et al. | 29/828 |
| 4,641,110 | 2/1987 | Smith | 174/36 X |
| 4,697,339 | 10/1987 | Verhoeven | 29/828 |
| 4,763,410 | 8/1988 | Schwartzman | 29/828 |
| 4,777,324 | 10/1988 | Lee | 174/34 |
| 5,068,632 | 11/1991 | Champeau | 174/117 FF X |
| 5,202,536 | 4/1993 | Buonanno | 174/35 R |

OTHER PUBLICATIONS

Technical Process Bulletin; Parker Amchem; Henkel Corporation; Bulletin No. 981; May 19, 1992.

Military Specification; Chemical Conversion Coatings on Aluminum and Aluminum Alloys; M1L-C-5541D, 28 Feb. 1989.

*Primary Examiner*—Morris H. Nimmo

*Attorney, Agent, or Firm*—Rogers & Killeen

[57] ABSTRACT

An electrically conductive cable is shielded from electromagnetic interference (EMI) with a mesh of aluminum wire that has been treated with a chromate conversion coating. The coating resists corrosion of the aluminum wire and galvanic reaction of the aluminum wire with dissimilar metals, thereby reducing degradation of shield effectiveness due to oxidation and allowing aluminum wire to be used to reduce shield weight in corrosive environments. The mesh may include a less compressible wire, such as tin plated copper, to alleviate cold flow problems.

20 Claims, 1 Drawing Sheet

DEVICE AND METHOD FOR SHIELDING AN ELECTRICALLY CONDUCTIVE CABLE FROM ELECTROMAGNETIC INTERFERENCE

BACKGROUND OF THE INVENTION

The present invention relates to shielding for electrically conductive cables, and more particularly, to a device and method for resisting the transfer of electromagnetic interference (EMI) to and from an electrically conductive core within a cable covered with a mesh of aluminum wire that is protected from corrosion.

Electrically conductive cables that carry signals among electrical components may be subjected to unwanted EMI from various external sources and may spray unwanted EMI to other nearby components. EMI may introduce unwanted, spurious signals into the cables or into the other components and includes interference from across the electromagnetic spectrum, including that found at radio frequencies. It is known to shield such cables so that spurious signals caused by the EMI are eliminated or reduced to acceptable levels. EMI shields operate by converting received electromagnetic energy into a current that is carried to a ground by the shield. To this end, the shield desirably has low electrical resistance and makes a secure contact with a connector to ground.

A cable 10 typical of the prior art is illustrated in FIGS. 1 through 4. As seen in FIGS. 1 and 2, a shield 12 may form a generally tubular shape surrounding an electrically conductive core 14. The core 14 may consist of one or more longitudinally extended wires 16 that may be loose singles, twisted pairs, shielded twisted pairs or coaxial cables as is known in the art. The core 14 may be covered with an insulative layer 18 or the wires in the core 14 may be individually insulated 20. The cable 10 may have connectors 22 for connecting the core 14 to electrical components (not shown) and for connecting the shield 12 to a ground. The connectors 22 have a backshell 24 that underlies an end portion 26 of the shield 12, and a strap 28 that overlies the end portion 26 and the backshell 24 to compressibly hold the shield 12 in place and electrically connect the shield 12 to the connector 22 (and thereby to a ground) as is known in the art. Other connecting means may be used as appropriate for the particular cable application.

With reference now to FIGS. 3 and 4, the shield 12 may be woven in a variety of patterns, with a braid being preferred (by way of example, a herring bone pattern is shown). The pattern may be created by weaving individual wire strands 30 onto the insulated core 14 in multi-stranded ribbons 32. Various techniques for weaving the wires are known and may include weaving machines having numerous (e.g., twenty four) spools of wire 30 that are woven onto the core. Typically, each of the spools has on it the number of strands being used to form a ribbon 32 so that each ribbon 32 is woven onto the core at one pass of the weaving machine. By way of example, a five-stranded ribbon 32 is illustrated in FIG. 4. Several layers of ribbons 32 may be woven onto the core.

The shielding effectiveness of the shield 12 is a measure (typically in db) of the change of EMI across the shield. As is known, shielding effectiveness is influenced by various factors, with the more significant being the number of layers of ribbons 32 in the shield 12, the braid angle (the angle A in FIG. 3) and the optical coverage (the portion of the circumference of the core 14 covered by the shield 12, the holes 34 not being covered in the illustrated examples). Shielding effectiveness improves with increased number of layers, smaller braid angle and increased optical coverage. Shielding effectiveness decreases as the frequency of the EMI increases (e.g., shield effectiveness is higher at 1 MHz than at 10 MHz.) Shielding effectiveness also increases as the electrical resistance associated with the shield 12 decreases. Such resistance is typically measured from the connector 22 at one end of the cable 10 to the connector 22 at the other end of the cable 10.

Various types of shields 12 are known and may be effective if one is willing to accept the weight added by the shield. For example, it is known that the wire 30 may be copper, or tin plated copper. However, in many applications, such as in moving vehicles (e.g., automobiles, aircraft, ships), the weight of the shield must be considered. Copper wire is relatively heavy and may be replaced with lighter aluminum wire. Aluminum wire is almost as effective as copper wire in shields and provides the added benefits of increased flexibility and lower cost for the wire itself.

However, there are significant disadvantages to using aluminum wire in cable shields in certain environments that heretofore have not been successfully overcome. The primary obstacle to the use of aluminum wire in cable shields is that aluminum corrodes easily. Bare aluminum oxidizes upon exposure to the air causing increased resistance, thereby reducing the effectiveness of a shield made of aluminum wire. Further, when aluminum contacts a dissimilar metal (e.g., copper, nickel, brass, stainless steel, silver) a galvanic reaction occurs that causes the aluminum to corrode more rapidly. Prolonged exposure to adverse environments, such as maritime environments, may reduce shielding effectiveness and make aluminum an unacceptable shielding material. In addition, the product of the corrosion, aluminum oxide, is powdery and highly abrasive, thereby hastening disintegration of the wire due to fretting (rubbing one wire against another).

A further problem with aluminum wire is that it is compressible and, when compressed, tends to flow away from the compressed area (a phenomena known as cold flow). In shielded cables such as illustrated in FIG. 1, the backshell 24 and the strap 28 compress the end portion 26 of the shield 12 causing cold flow. When the shield cold flows, the connection of the shield to the connector is degraded and the resistance increases between the shield 12 and the connector 22. As discussed above, increased resistance reduces shielding effectiveness.

Accordingly, it is an object of the present invention to provide a novel device and method for shielding an electrically conductive cable that obviates the problems of the prior art.

It is a further object of the present invention to provide a novel device and method for shielding an electrically conductive core with a mesh of aluminum wire that has been treated with a chromate conversion coating to resist corrosion.

It is yet a further object of the present invention to provide a novel device and method for reducing EMI transferred to and from an electrically conductive core in a cable shielded with an aluminum wire mesh in which the cold flow problem has been alleviated.

It is another object of the present invention to provide a novel device and method for reducing EMI through the use of a mix of tin plated copper wire and aluminum wire treated with a chromate conversion coating.

These and many other objects and advantages of the present invention will be readily apparent to one skilled in the art to which the invention pertains from a perusal of the claims, the appended drawings, and the following detailed description of preferred embodiments.

DESCRIPTION OF PREFERRED EMBODIMENTS

In extensive tests it has been found that the most effective way to reduce the weight of a shielded cable that is to be used in a corrosive (e.g., maritime) environment is to reduce the weight of the shield, and that the most effective way to reduce the weight of the shield is to substitute aluminum wire for the tin plated copper wire traditionally used in cable shields, PROVIDED the disadvantages discussed above could be overcome.

In the device and method of the present invention all of the disadvantages discussed above are obviated by treating aluminum wire with a chromate conversion coating before the wire is woven into a shield. The chromate conversion coating is bonded to the surface of the aluminum wire so it resists cracking and peeling, is relatively light weight so that the weight advantage of using aluminum is maintained, and more importantly resists oxidation of the aluminum. In addition, the corrosion resistance provided by the chromate conversion coating reduces formation of aluminum oxide powder so that fretting is reduced, and provides a separation from dissimilar metals to slow or stop the galvanic reaction of aluminum with dissimilar metals.

Various chromate conversion coating treatments are known, such as that offered under the trademark ALODINE by Henkel Corporation of Madison Heights, Mich. (The treatment is also known as an iridite chromatic conversion.) In such treatments, the aluminum wire is cleaned, bathed in solution that may include chromic acid ($H_2CrO_4$) and ferricyanide, rinsed and dried. The coated wire may be placed on a spool for subsequent use in the shield weaving process. The Technical Process Bulletin for the ALODINE treatment is incorporated herein by reference.

Significantly, while such chromate conversion coating treatments have been applied to some aluminum structures (e.g., aluminum tanks, boxes and tubes) it has been unknown heretofore to apply the treatment to aluminum wire as claimed herein.

The aluminum wire is desirably treated with a chromate conversion coating so that the electrical resistance of the aluminum wire is not substantially increased. For example, the coating may have a resistance of less than about 5000 microhms per square inch when applied. As is known, the resistance of the coating will increase somewhat over time, but desirably remains less than about 10,000 microhms per square inch.

The aluminum wire that is coated desirably has a gauge of 34 to 38 AWG, depending on the application (e.g., for cables carrying radio frequency signals, for power and video cables.) In general, however, the selection of wire size is related to overall cable size and desired optical coverage that, in part, determines shielding effectiveness.

Figure 1:
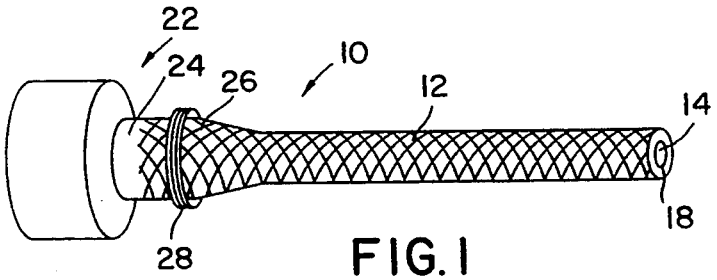
FIG. 1 (PRIOR ART)
FIG. 1 is a pictorial representation of a segment of a shielded cable of the prior art.
Figure 2:
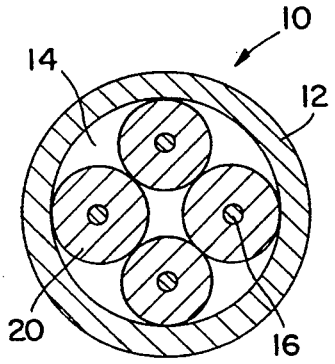
FIG. 2 (PRIOR ART)
FIG. 2 is vertical cross-section of a shielded cable of the prior art illustrating a multi-stranded electrically conductive core.
Figure 3:
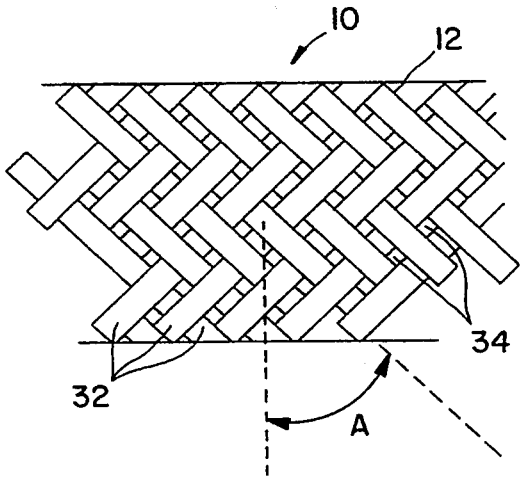
FIG. 3 (PRIOR ART)
FIG. 3 is a pictorial representation of the surface of the shield of the cable of FIG. 1, illustrating a typical weave pattern.
Figure 4:
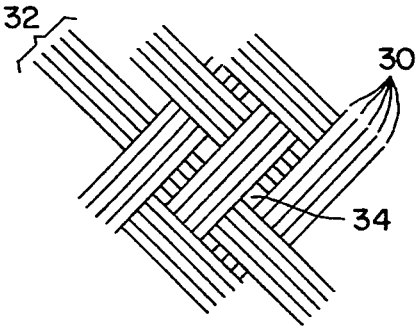
FIG. 4 (PRIOR ART)
FIG. 4 is a pictorial representation of the prior art pattern of FIG. 3 illustrating the composition of individual ribbons.
Figure 5:
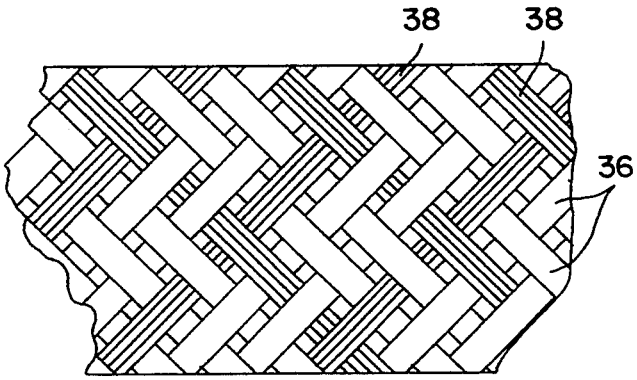
FIG. 5 is a pictorial representation of a wire weave illustrating the mixed ribbon types in an embodiment of the present invention.

A foil provides 100% optical coverage when used as a shield. A braid, such as illustrated in FIG. 3, forms holes that decrease optical coverage. The size of the hole is function of the braiding machine, the wire gauge, the number of wire strands per ribbon, the core outer diameter and the braid angle. Optical coverage desirably exceeds 90% and is preferably about 95% or more. In the present invention, these factors may vary, although it has been found that a suitable shield may be formed on a 24 or 48 spool weaving machine using 36 AWG chromate conversion coated aluminum wire, with about 10 strands of the wire per ribbon, and a braid angle of about 30°–45°. Other braid angles (e.g., between about 20° and 75°) and other ribbon sizes (e.g., about 5 to 18 strands per ribbon) are also acceptable. The coated aluminum wire may be woven onto the core in one or more layers of ribbons, with two layers being preferred, such as illustrated in FIG. 5 by top layer 40 and lower layer 42. Any weave pattern may be used, although the herring bone pattern shown in FIG. 3 has found wide acceptance.

In a further embodiment, aluminum wire may be woven onto the core with another type of wire that is less compressible than aluminum to reduce the degradation of shielding effectiveness due to cold flow. The less compressible wire provides a support for the aluminum wire so that compression is eliminated or reduced when the shield is compressibly attached to the backshell by the strap. For example, tin plated copper wire may be placed at intervals among the aluminum wire to prop up the aluminum wire, albeit with some increase in weight associated with the use of copper instead of aluminum. The interval may be appropriate for the application and may be chosen in view of the type of weaving machine being used. For example, in a weaving machine having 24 spools, the number of copper wire ribbons used may be any whole number factor of 24 (e.g., 2, 3, 4, 6, etc.). The less compressible wire may be mixed with the aluminum wire, and is preferably provided in whole ribbons as illustrated in FIG. 5 (ribbons 36 of coated aluminum wire being mixed with ribbons 38 of less compressible wire). As further illustrated in FIG. 5, the ribbons of less compressible wire 38, such as tin plated copper wire, may comprise about one-third of the ribbons.

Test results have indicated that the shielding effectiveness of the double layer chromate conversion coated aluminum wire shield is about 5 db inferior to that of a similar double layer tin plated copper wire shield. However, the weight savings were significant as the aluminum wire has a weight that is only about one-third that of the copper wire (total cable weight savings depend on the length of the cable). Further, after exposure to a salt fog test environment for seven days, the copper wire shielding effectiveness degraded by 9 to 10 db, while the shielding effectiveness of the chromate coated aluminum wire degraded by only 4 db. The initial difference in shielding effectiveness may be overcome by increasing optical coverage.

The present invention has been tested using a transfer impedance measuring technique. A transfer impedance test measures the amount of energy transferred (leaked) from outside the test cable to the test cable's inner conductor. The transferred energy is represented by a voltage source at the inner conductor. The ratio of this voltage to the outside energy, represented by the surface current on the cable shield, is defined as the transfer impedance. Lower transfer impedance indicates better shielding effectiveness. Exemplary test results for various test cables at two frequencies are shown in Table 1 below. Cables 1 and 2 are prior art cables with tin plated copper wire shields (a single layer of ribbons in Cable 1 and two layers of ribbons in Cable 2). Cables 4 and 5 are cables of the present invention with chromate conversion coated aluminum wire shields, including a ribbon of tin plated copper wire for every sixth ribbon (a single layer of ribbons in Cable 4 and two layers of ribbons in Cable 5). Cables 7 and 8 are also cables of the present invention with chromate conversion coated aluminum wire (a single layer of ribbons in Cable 7 and two layers of ribbons in Cable 8).

TABLE 1

| Cable Number | Weight (1) | Resistance (2) | Transfer Impedance (3) | Transfer Impedance (4) |
|---|---|---|---|---|
| 1 | 43 | 14 | −42 | −37 |
| 2 | 82 | 7 | −61 | −57 |
| 4 | 22 | 27 | −38 | −33 |
| 5 | 41 | 14 | −56 | −51 |
| 7 | 18 | 48 | −38 | −35 |
| 8 | 31 | 25 | −53 | −49 |

(1) Weight of the test cable in grams, less connectors, each cable being about one meter in length.
(2) Resistance of the test cable in milliohms measured from connector to connector.
(3) Transfer impedance (db) at 30–40 MHz.
(4) Transfer impedance (db) at 125–130 MHz.

While preferred embodiments of the present invention have been described, it is to be understood that the embodiments described are illustrative only and the scope of the invention is to be defined solely by the appended claims when accorded a full range of equivalence, many variations and modifications naturally occurring to those skilled in the art from a perusal hereof.

What is claimed is:

1. A method of reducing the amount of unwanted electromagnetic energy transferred to and from an electrically conductive, longitudinally extended core in a cable covered with a tubular wire shield comprising the steps of:

insulating a core in a cable so that the core can not be directly contacted along its longitudinal extent;

applying a chromate conversion coating to aluminum wire so that bare aluminum wire is not exposed and so that the electrical resistance of the wire is not substantially increased; and braiding plural strands of the coated aluminum wire onto the insulated core in at least one layer to form a tubular wire shield comprising a mesh of multi-stranded ribbons that reduces the transfer of electromagnetic energy to and from the core and that is resistive to corrosion and galvanic reaction.

2. The method of claim 1 further comprising the steps of providing strands of a second wire that is less compressible than aluminum wire and braiding strands of the second wire onto the core with the coated aluminum wire so that the second wire reduces compression of the coated aluminum wire when the braided strands of both the wires are compressibly mounted onto a connector for the cable.

3. The method of claim 2 wherein the second wire is tin plated copper wire.

4. The method of claim 1 wherein the plural strands are braided in ribbons having a braid angle of between about 20° and 75°.

5. A method of making a shielded, electrically conductive cable comprising the steps of:

providing an insulated, electrically conductive core;

applying a chromate conversion coating to aluminum wire that does not substantially increase the electrical resistance of said aluminum wire;

plating copper wire with tin;

braiding said coated aluminum wire and said plated copper wire onto said core so that said coated aluminum wire and said plated copper wire are in separate multi-stranded ribbons in a tubular wire mesh shield about said core; and affixing connectors to the ends of said core and said tubular wire mesh shield, said connectors having means for compressibly attaching said tubular wire mesh shield thereto, whereby said ribbons of said plated copper wire reduce the compression of said ribbons of said coated aluminum wire.

6. A tubular shield of braided wire for shielding an electrically conductive core in a cable from electromagnetic interference comprising a plurality of aluminum wires that are braided to form a tubular shield, each of said wires treated with a chromate conversion coating so that bare aluminum wire is not exposed and so that the electrical resistance of the wire is not substantially increased.

7. The shield of claim 6 further comprising plural strands of a second wire that is less compressible than aluminum wire that have been braided onto said core with said coated aluminum wire so that said second wire reduces compression of said coated aluminum wire when the braided strands of both said wires are compressibly mounted onto a connector for the cable.

8. A shielded electrically conductive cable comprising:

an insulated, electrically conductive core;

plural strands of aluminum wire treated with a chromate conversion coating; and plural strands of tin plated copper wire, said coated aluminum wire and said coated copper wire being braided onto said insulated core so that said coated aluminum wire and said coated copper wire are braided in separate multi-stranded ribbons in a tubular wire mesh shield about said core; and connectors affixed to ends of said core and said tubular wire mesh shield, said connectors comprising means for compressibly attaching said tubular wire mesh shield thereto, whereby said ribbons of said plated copper wire reduce the compression of said ribbons of said coated aluminum wire.

9. The method of claim 1 wherein two layers of ribbons are formed.

10. The method of claim 2 wherein the strands of the second wire are formed into multi-stranded ribbons, and wherein the ratio of multi-stranded ribbons of aluminum wire to multi-stranded ribbons of the second wire is about two to one.

11. The method of claim 4 wherein the braid angle is between about 30° and 45°.

12. The method of claim 5 wherein the aluminum wire comprises from 34 to 38 AWG aluminum wire, wherein the braided ribbons of aluminum wire have from five to eighteen strands of wire per ribbon, and wherein the ribbons have a braid angle between about 20° and 75°.

13. The method of claim 5 wherein one third of the multi-stranded ribbons comprise the tin plated copper wire.

14. The method of claim 13 wherein the ribbons are in a herringbone pattern.

15. The shield of claim 6 wherein said wires comprise from 34 to 38 AWG wire, wherein said wires are in two layers of braided ribbons with from five to eighteen of said wires per ribbon, and wherein said ribbons have a braid angle between about 20° and 75°.

16. The shield of claim 15 wherein said wires comprise 36 AWG wire, wherein there are ten of said wires per ribbon and wherein said ribbons have a braid angle between about 30° and 45°.

17. The shield of claim 16 wherein said ribbons are in a herringbone pattern.

18. The cable of claim 8 wherein said strands of aluminum wire comprise from 34 to 38 AWG aluminum wire, wherein said braided ribbons of said strands of aluminum wire have from five to eighteen said strands per ribbon, and wherein said ribbons have a braid angle between about 20° and 75°.

19. The cable of claim 8 wherein one third of said multi-stranded ribbons comprise strands of said tin plated copper wire.

20. The cable of claim 19 wherein said ribbons are in a herringbone pattern.

* * * * *